United States Patent [19]

Foster et al.

[11] Patent Number: 4,669,552

[45] Date of Patent: Jun. 2, 1987

[54] POWER DRIVING APPARATUS

[76] Inventors: J. Marlo Foster; Fred C. Pierce, II, both of P.O. Box 30177, Billings, Mont. 59107

[21] Appl. No.: 757,241

[22] Filed: Jul. 22, 1985

[51] Int. Cl.[4] ..... B25D 11/12

[52] U.S. Cl. ..... 173/117; 173/119; 173/122; 173/130

[58] Field of Search ..... 173/81, 88, 117, 118, 173/119, 120, 121, 123, 130, 122

[56] References Cited

U.S. PATENT DOCUMENTS

| | | | |
|---|---|---|---|
| 1,847,135 | 3/1932 | Oldham | 173/130 |
| 1,932,259 | 10/1933 | Warren | 173/123 |
| 2,519,477 | 8/1950 | Kind | 173/122 |
| 2,626,598 | 1/1953 | Tarwater | 173/119 |
| 3,256,945 | 6/1966 | Grospas | 173/88 |
| 3,587,754 | 6/1971 | Laatsch | 173/117 |
| 3,937,286 | 2/1976 | Wagner | 173/119 |

*Primary Examiner*—Robert P. Olszewski
*Attorney, Agent, or Firm*—Arthur L. Urban

[57] ABSTRACT

Power driving apparatus includes a body portion, a power supplying portion, an actuating portion, a drive portion, a biasing portion and a surface contacting portion. The body portion includes a vertically oriented elongated tubular section, the tubular section including a substantially open lower end. The power supplying portion includes a power source affixed to the body portion spaced from the open lower end thereof, the power source including an output shaft member disposed transversely of the body portion. The actuating portion includes a rotatable eccentric supported transversely axially within the body portion, the eccentric being spaced from the open lower body end substantially parallel to the output shaft member. An arm member has one end pivotally connected to the eccentric and extends therefrom downwardly toward the open lower body end. A weighted hammer section is supended from a lower free end of the arm member and disposed within the body portion. The drive portion includes drive mechanism operatively connecting the output shaft member with the eccentric. The biasing portion includes a coil spring member having one end operatively connected to the hammer section, the coil spring member urging the hammer section toward the open lower body end. The surface contacting portion includes a toolhead member disposed adjacent the open lower body end and axially aligned therewith.

20 Claims, 9 Drawing Figures

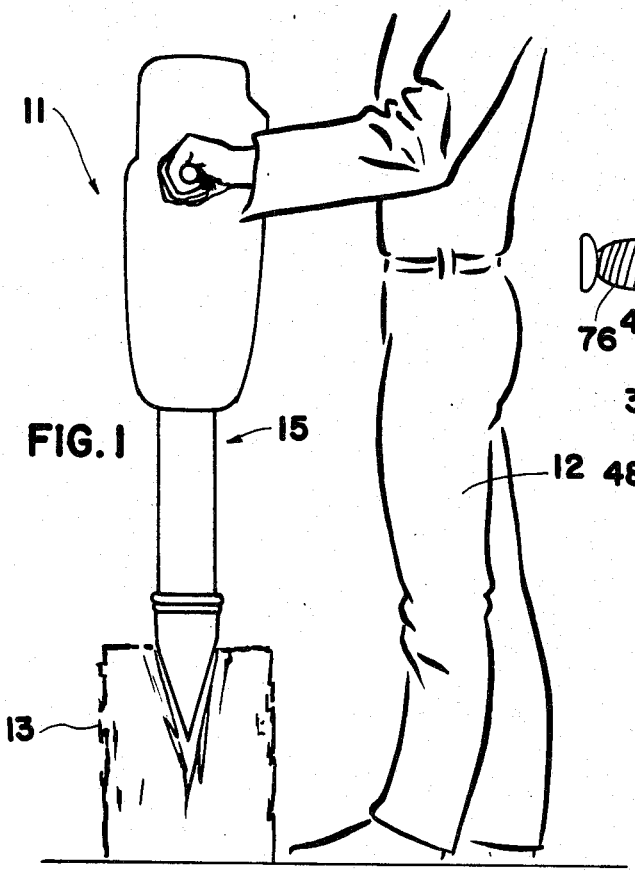
FIG. 1
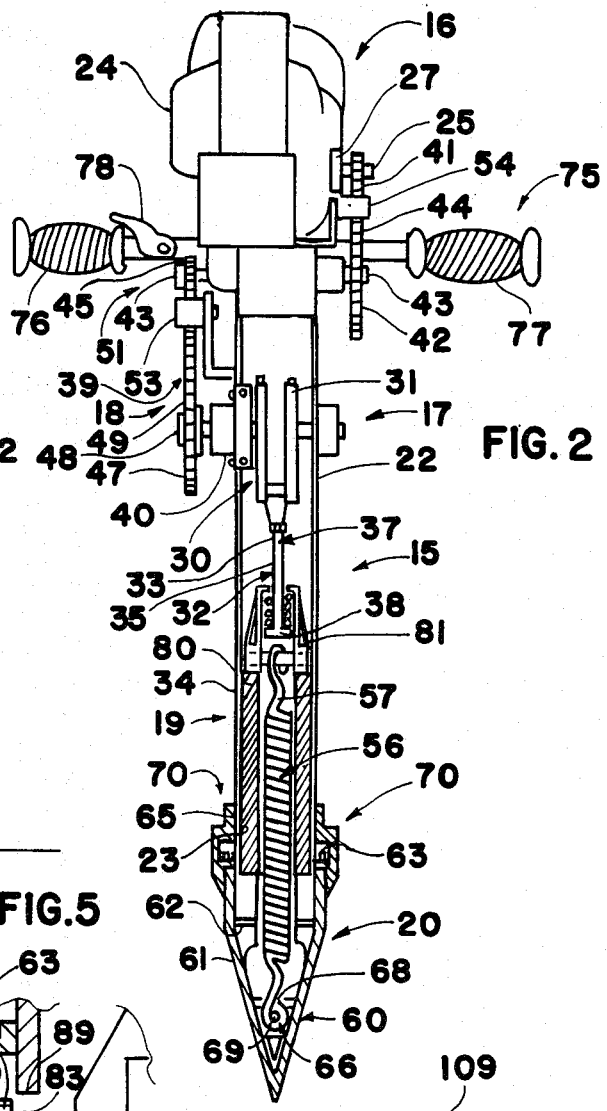
FIG. 2
FIG. 3
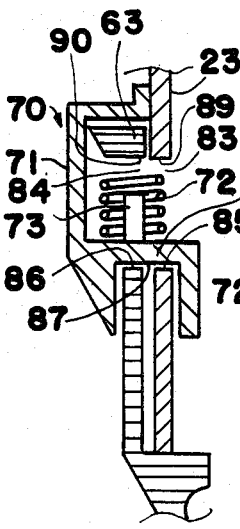
FIG. 4
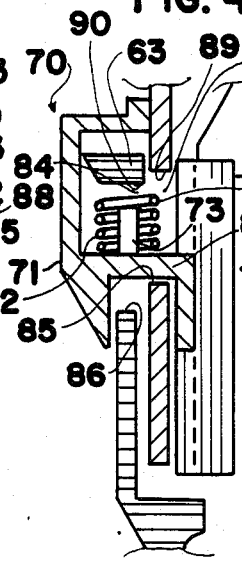
FIG. 5
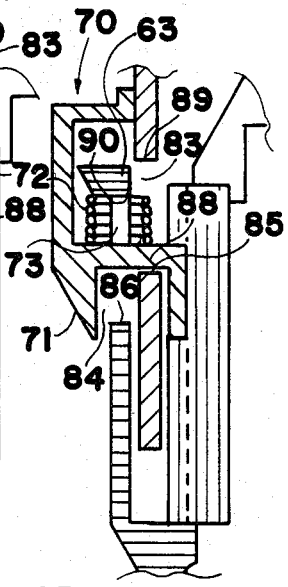
FIG. 9
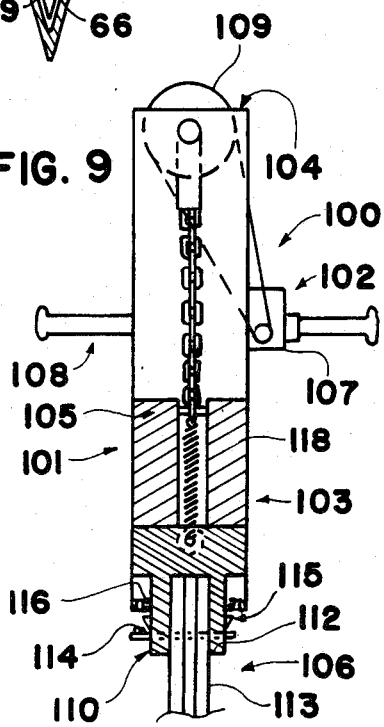
FIG. 6
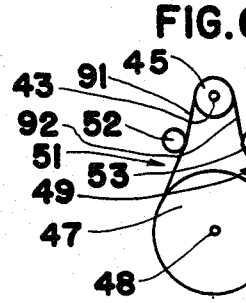
FIG. 7
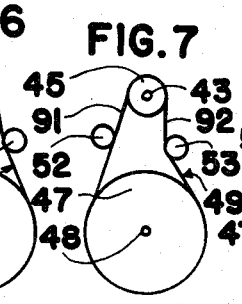
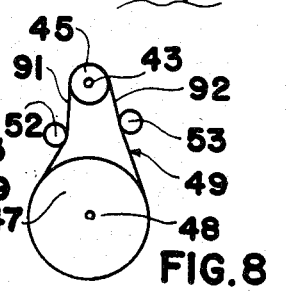
FIG. 8

POWER DRIVING APPARATUS

BACKGROUND OF THE INVENTION

This invention relates to a novel apparatus and more particularly relates to a new apparatus utilizing power for driving tools.

In primitive societies, most tasks were performed by hand. Simple tools were all that were available so people had to rely on their strength either individually or in groups. Hammers, axes and similar tools were utilized to assemble or divide components and the like.

As civilization evolved, specialization came into existence. Individuals developed skills or talents that enabled them to earn a living doing particular tasks. Some persons prepared building materials, others constructed buildings, still others produced furnishings for the buildings. These experts continued to employ hand tools but they were modified for the specific task that the individual performed as his primary work.

With the development of combustion engines and electrical motors, many hand tools were redesigned to accommodate the motors. Initially, these power sources were large and cumbersome, so they generally were employed with tools that could be used at a permanent location. As the designs of motors and engines were refined, power sources became available that were smaller in size and lighter in weight. This enabled tool manufacturers to offer portable power tools that could be transported to the work site rather than the other way around.

Power saws, drills, hammers and the like were adopted by many professionals since such tools enabled a craftsman to accomplish more in a given period of time with much less effort and fatigue. Even amateurs such as homeowners or hobbyists started to use power tools because of their convenience. Amateurs avoided purchasing power tools only when they could find no way to justify or rationalize the expenditure.

Although the popularity of power tools increased tremendously through the years, some tasks ordinarily still are performed using hand tools. Such a situation frequently occurs when the power tools that are available for the particular task present their own problems. The problems may include high cost and more commonly significant deficiencies in performance and/or convenience.

One such task is the splitting of logs for firewood. Although a number of different power splitters have been proposed, most people still perform the task with hand tools such as a maul and a wedge. One log splitting device that received considerable publicity for a short period of time included a giant tapered screw that was connected to a power source. One embodiment involved the attachment of the screw to a wheel of a vehicle that had been raised off the ground. The user pushed the log manually against the rotating end of the screw so the screw could advance into the log and split it into pieces.

While this device in theory appeared to be a useful means for splitting a log, in practice it presented very serious drawbacks. One was the high risk of injury to the user through accidental contact with the screw.

This risk was increased by the fact that operation of the screw required a second person in the vehicle to control the rotation of the screw. Since this required that one person be inside the vehicle and another outside at the front or rear of the vehicle close to the ground, it was very difficult for one person to communicate with the other while performing his part of the operation. In case of an emergency, the parties could not communicate quickly enough to avert serious injury. This device has been withdrawn from the market.

A power log splitter that currently is being used to some extent is the hydraulic ram apparatus. These units are mounted with engines on trailers that are towed to the work site. Since they are very expensive, a casual wood splitter ordinarily rents the machine rather than purchasing his own unit.

To use the apparatus after the engine has been started, a log is placed in a cradle in the path of the ram with one end against a fixed stop member. Thereafter the hydraulic cylinder driving a wedge-shaped ram is activated forcing the wedge through the log.

Although hydraulic ram devices can successfully split logs, they are not without their own problems. One is that they are very expensive. Two, they are cumbersome to move and use. Most importantly, they are dangerous to use since the force applied to the log is quite great which may cause a log to split so violently that the pieces fly in all directions. Thus, if the person splitting the logs or bystanders do not exercise a high degree of care, someone may be struck with a flying fragment and injured seriously.

From the above discussion, it is clear that previously proposed power driven tools have been less than satisfactory in some applications and particularly for splitting logs. Thus, there is a need for a new powerized apparatus that overcomes the shortcomings of earlier devices.

The present invention provides a novel power driving apparatus with features and advantages not found in previous devices. The power driving apparatus of the invention provides the operator with a high degree of control over the use thereof. This reduces the risk of injury. Since an operator can control closely the rate at which force is applied, the risk of objects flying into the surrounding area is greatly reduced.

The power driving apparatus of the present invention is simple in design and can be produced relatively inexpensively. Commercially available materials and components can be used in the manufacture of the apparatus of the invention. Conventional metal fabrication techniques and procedures can be employed using semi-skilled labor in the manufacture thereof.

The power driving apparatus is light in weight and can be carried to the job site. Most adults can use the apparatus of the invention conveniently and efficiently after only a minimum of instruction. The apparatus can be employed for a variety of tasks including log splitting; driving of posts, piles, casing, etc.; hammering; crushing and the like.

The apparatus is durable in construction and has a long useful life. Little maintenance is required to keep the apparatus in good working condition. The apparatus can be adapted easily to accomodate different operating conditions.

BRIEF DESCRIPTION OF THE DRAWINGS

These and other benefits and advantages of the novel power driving apparatus of the present invention will be apparent from the following description and the accompanying drawings in which:

FIG. 1 is a side view of one form of the power driving apparatus of the invention being used to split a log;

FIG. 2 is an enlarged left side view partially in section of the power driving apparatus shown in FIG. 1;

FIGS. 3, 4 and 5 are fragmentary side views in section showing positions of related portions at different stages of the operation of the power driving apparatus shown in FIGS. 1 and 2;

FIGS. 6, 7 and 8 are fragmentary left side views of the power driving portion at different stages of operation of the apparatus shown in FIGS. 1 and 2; and FIG. 9 is a side view in section of a post driving form of the power driving apparatus of the invention.

DESCRIPTION OF THE PREFERRED EMBODIMENTS

As shown in FIGS. 1–7 of the drawings, one form of the power driving apparatus 11 of the present invention is being used by an individual 12 to split a log 13. The power driving apparatus 11 of the invention includes a body portion 15, a power supplying portion 16, an actuating portion 17, a drive portion 18, a biasing portion 19 and a surface contacting portion 20.

The body portion 15 of the power driving apparatus 11 of the invention includes a vertically oriented elongated tubular section 22. The tubular section 22 includes a substantially open lower end 23. Advantageously, the body portion has a generally circular cross section.

The power supplying portion 16 of the power driving apparatus 11 of the invention includes a power source 24. The power source is affixed to the body portion 15 and is spaced from the lower end 23 thereof. The power source includes an output shaft member 25 that is disposed transversely of the body portion.

Advantageously, the power source 24 may be any of a variety of conventional power sources such as gasoline engines; electric, air or hydraulic motors; handcranks or the like. Advantageously, the power source is a gasoline engine of the type employed on chain saws, grass trimmers or similar devices to provide maximum portability and flexibility of use.

The power source 24 may be affixed to the body portion adjacent an upper end thereof. Alternatively, the power source may be affixed intermediate along the length of the body portion to lower the center of gravity or for other objectives. The power source preferably includes clutch means 27 such as a centrifugal clutch associated with the output shaft member 25.

The actuating portion 17 of the power driving apparatus 11 of the present invention includes rotatable eccentric means 30. The eccentric means 30 is supported transversely axially within the body portion. The eccentric means is spaced from the open lower end 23 of the body portion and disposed substantially parallel to the output shaft member 25 of the power source 24.

The rotatable eccentric means 30 advantageously includes a crank member 31. Preferably, the eccentric means is disposed along the upper half of the body portion. The eccentric means also may be a half cam or similar device.

The actuating portion 17 further includes an arm member 32. One end 33 of the arm member 32 is pivotably connected to the eccentric means 30. The arm member 32 extends downwardly therefrom toward the open lower end 23 of the body portion 15. A weighted hammer section 34 is supended from the lower end 35 of the arm member. The arm member 32 and the hammer section 34 are both disposed within the body portion.

Advantageously, the arm member 32 is a rod member 37 as shown in FIG. 2. With a rigid arm member, it is preferable to include shock absorbing means such as coil spring 38. Alternatively, the arm member may be a more flexible element such as a chain, spring, cable, cord, rope, belt, etc. The hammer section 34 may have a number of raised peripheral areas that contact the internal surface of the body portion.

The drive portion 18 of the power driving apparatus 11 includes drive mechanism 39 operatively connecting the output shaft member 25 with the rotatable eccentric means 30. The drive portion 18 advantageosuly includes clutch means 40 such as an indexing clutch to allow the eccentric means to rotate freely over a part of each revolution. If desired, a ratchet may be utilized in place of the clutch.

The drive portion 18 may include sprockets on the output shaft member 25 and the eccentric means 30 connected by an endless drive element such as a chain or belt. More advantageously, as shown in the drawings, a sprocket 41 on the output shaft member 25 is connected with a sprocket 42 on an intermediate shaft 43 through an endless drive element 44. The opposite end of shaft 43 with a sprocket 45 is connected to a sprocket 47 on a shaft 48 through the eccentric means 30 using a second endless drive element 49. In certain applications, intermeshed gear assemblies (not shown) may be employed in the drive portion.

Preferably, shock absorbing means 51 is provided in association with the endless drive element 49. The shock absorbing means advantageously yieldably bears against the drive element. For example, a pair of rollers 52 and 53 may be biased against areas of the drive element 49 in symmetrical positions between the sprockets 45 and 47. Also, a tensioning roller 54 may be in yieldable contact with drive element 44.

The biasing portion 19 of the power driving apparatus 11 of the invention includes a coil spring member 56. An upper end 57 of the coil spring is operatively connected to the hammer section 34. The coil spring 56 urges the hammer section toward the open lower end 23 of the body portion 15. The biasing portion 19 advantageously is disposed within the body portion. Preferably, the coil spring member 56 is axially aligned within the body portion.

The surface contacting portion 20 of the power driving apparatus 11 includes a toolhead member 60. The toolhead member 60 is disposed adjacent the open lower end 23 of the body portion and is axially aligned therewith. The toolhead member may be any of a variety of different driving members. Advantageously, the toolhead member is a wedge member 61 with an internal striking surface 62. The wedge preferably includes a collar 63 approximately the same diameter as the body portion to provide a substantially continuous surface therewith. Alternatively, the toolhead may be a tapered rod, a socket or a similar configuration.

Guide means 65 is located adjacent the open lower end 23 of the body portion. The guide means aligns the toolhead member with respect to the body portion and the hammer section 34. Holding means 66 retains the toolhead member with the body portion. This holding means advantageously may be a connection between the lower end 68 of the coil spring member 56 and a cross bolt 69 within the toolhead.

The power driving apparatus 11 also preferably includes shock absorbing means 70 disposed between adjacent surfaces of the toolhead member 60 and the body portion 15. As shown in FIGS. 3–5, such shock absorbing means may include a plurality of spaced housings 71 with coil springs 72 disposed over stop members 73 adjacent the periphery of the body portion.

The power driving apparatus further advantageously may include a handle portion 75. The handle portion preferably includes gripping means 76 and 77 that extend in opposite directions from the body portion 15.

The power driving apparatus 11 may be fabricated from any of a wide variety of different materials including steel, aluminum, plastics, combinations thereof and the like. Advantageously, components such as the body and toolhead portions may include sidewall openings to facilitate assembly of the apparatus.

The power driving apparatus 11 as shown in the drawings may be assembled by affixing the power source 24 on the body portion 15. Next shaft 43, crank member 31 and indexing clutch 40 together with suitable bearings are mounted along the length of the body portion and operatively connected to the output shaft member 25 of the power source 24 through sprockets 41, 42, 45 and 47 and drive elements 44 and 49. Also, shock absorbing means 51 including yieldable rollers 52 and 53 is mounted for engagement with drive element 49. The handle portion 75 is affixed on the body portion.

End 35 of rod member 37 is connected to an end 80 of hammer section 34 through a suitable bracket 81 and coil spring 56 is affixed to the hammer section. The combination then is inserted into the open end 23 of the body portion with free end 33 of the rod member 37 threadedly engaging the eccentric area of the crank member 31.

Wedge member 61 then is slipped over the lower end 23 of the body portion and attached to the exposed end 68 of the coil spring 56. Preferably, the connection is made through an opening in the side of the wedge. To complete the assembly, shock absorbing means 70 including housing 71, spring 72 and stop member 73 are mounted in cutouts 83 and 84 in the body portion and wedge member respectively. The power driving apparatus 11 now is ready for use.

To use apparatus 11, handle grips 76 and 77 are grasped and the apparatus is positioned over an upright log 13 with the wedge member 61 bearing on the log. Then, the power source 24 is activated.

To begin the splitting operation, control 78 is actuated causing the engine to accelerate and drive the crank member 31 under load. Movement of the crank causes the assembly of the rod member 37 to reciprocate the hammer section 34 within the body portion to repeatedly strike a surface 62 of the wedge 61 driving the wedge into the log.

With a power source rotating at 4000 RPM and drive train having a ratio of 40 to 1, the crank will rotate at about 100 RPM. These operating conditions provide several hammer blows per second. However, by changing the ratio of the drive train or accelerating the engine, the number of strikes can be increased or decreased.

With a setup having several hammer blows per second, soft woods can be split in less than 10 seconds and hard woods in less than about one-half minute. An important advantage of the power driving apparatus 11 of the invention is the controlled advance of the wedge member 61 through the log. This controlled advance causes the pieces to slowly fall aside rather than fly through the air. This slow advance keeps the pieces close by and reduces the risk of injury to bystanders or damage to surroundings.

FIGS. 3–5 illustrate the relative positions of components of the apparatus 11 during the splitting operation. FIG. 3 shows the various components at the top of their strokes. The lower edges 85 and 86 of the cutouts 83 and 84 of the body portion and the wedge member respectively are close to the underside 87 of the transverse section 88 of shock absorber housing 71. The upper edges 89 and 90 of the cutouts 83 and 84 are spaced from spring 72 and stop 73 of the shock absorber.

In FIG. 4 are shown the components when the hammer 34 has struck the wedge member 61 with the point of the wedge being resisted by the log. The wedge has moved downwardly so the cutout edge 86 thereof is spaced from the underside of the transverse section 88.

FIG. 5 illustrates an extreme downward position of the components when the log has separated from the wedge. In this condition, the wedge has moved further downwardly so the upper edge 90 of the wedge cutout 84 has compressed spring 72 and advanced against stop 73.

FIGS. 6–8 illustrate different conditions in the operation of the drive portion. FIG. 6 shows the position of rollers 52 and 53 with respect to drive element 49 when the power source 24 is not operating. FIG. 7 illustrates the displacement of the respective rollers when the drive element 49 is driving the crank 31 normally. The roller 52 on one side 91 of the drive element 49 that is in greater tension yields to the tension, while the roller 53 on the opposite side 92 of the driving element moves against the lesser tension area.

In contrast, when a kick-back condition occurs such as if the wedge is caught in the log, the tensions in the respective lengths of the drive element 49 reverse as shown in FIG. 8. Since the rollers 52 and 53 are yieldably supported, they can be displaced to absorb shock in the drive element that otherwise would be transmitted through the structure of the apparatus.

FIG. 9 illustrates a post driving form of the power driving apparatus 100 of the present invention. The apparatus 100 includes a body portion 101, a power supplying portion 102, an actuating portion 103, a drive portion 104, a biasing portion 105 and a surface contacting portion 106.

The body portion 101, the drive portion 104 and the biasing portion 105 are similar to the respective portions of the log splitting apparatus 11 of the invention described above.

The principal differences between the post driving apparatus 100 and the log splitting apparatus 11 are in the location of the power supplying portion 102 with power source 107 being mounted along the length of the body portion rather than on the upper end thereof. This positioning of the power source is selected to lower the center of gravity of the apparatus to avoid topheaviness. Also, handle portion 108 is lower on the body portion to make holding of the apparatus in a raised position at the top of a post more convenient.

With the power source 107 in a lower position, crank 109 is located at the top of the body portion to minimize the length thereof. Toolhead member 110 includes an opening 112 in the lower end thereof to receive the top of a post 113. Also, biasing means 114 may be included to hold the post within the slot, as well as stop means 115 and shock absorbing means 116 as described above.

Operation of the post driver 100 is similar to that of log splitting apparatus 11. Power source 107 is activated with the toolhead 110 in contact with the top of a post 113. Crank 109 rotates, raising and lowering chain 117 secured thereto to lift and drop hammer section 118 within the body portion 101 to repeatedly strike an upper surface of toolhead 110 driving post 113 into the ground.

In the same way, other toolheads may be employed such as a tapered rod to break up hard materials or a flat surface may be used to drive casing, nails and the like. In each situation, the task is accomplished easily and quickly with a minimum of effort.

The above description and the accompanying drawings show that the present invention provides a novel power driving apparatus with features and advantages not found in previous devices. Risk of injury is greatly reduced since the operator has a high degree of control of the operation. The apparatus is light in weight and can be carried to the job site conveniently. Adults can use the apparatus efficiently ater only a minimum of instruction.

The power driving apparatus of the invention is simple in design and can be produced relatively inexpensively. Commercially available materials and components and conventional fabricating procedures can be utilized in its manufacture. The apparatus is durable in construction and requires little maintenance.

It will be apparent that various modifications can be made in the particular power driving apparatus described in detail above and shown in the drawings within the scope of the present invention. The size, configuration and arrangement of components can be changed to meet specific requirements. A protective housing may be placed around the drive components if desired. Also, other shock absorbing means may be utilized. In addition, the speed and power of the apparatus may be increased for commercial applications or tasks requiring the application of greater force. These and other changes can be made in the power driving apparatus of the invention providing the functioning and operation thereof are not adversely affected. Therefore, the scope of the present invention is to be limited only by the following claims.

What is claimed is:

1. Power driving apparatus including a body portion, a power supplying portion, an actuating portion, a drive portion, a biasing portion and a surface contacting portion; said body portion including a vertically oriented elongated tubular section, said tubular section including a substantially open lower end; said power supplying portion including a power source affixed to said body portion spaced from said open lower end of said body portion, said power source including an output shaft member disposed transversely of said body portion; said actuating portion including rotatable eccentric means supported transversely axially within said body portion, said eccentric means being spaced from said open lower end of said body portion substantially parallel to said output shaft member of said power source, an arm member having one end pivotally connected to said eccentric means and extending therefrom downwardly toward said open lower end of said body portion, a weighted hammer section suspended from a lower free end of said arm member and disposed within said body portion; said drive portion including drive mechanism operatively connecting said output shaft member of said power supplying portion with said eccentric means of said actuating portion; said biasing portion including a coil spring member having one end operatively connected to said hammer section, said coil spring member urging said hammer section toward said open lower end of said body portion; said surface contacting portion including a toolhead member disposed adjacent said open lower end of said body portion and axially aligned therewith, said toolhead member being operatively connected to an end of said coil spring member opposite to said end thereof that is operatively connected to said hammer section, guide means adjacent said open lower end of said body portion aligning said toolhead member, and holding means retaining said toolhead member with said body portion; whereby said power source drives said rotatable eccentric means to raise said arm member cyclically to reciprocate said hammer section within said body portion against said biasing portion so that said hammer section intermittently and repeatedly strikes an upper surface of said toolhead member.

2. Power driving apparatus according to claim 1 wherein said body portion has a generally circular cross section.

3. Power driving apparatus according to claim 1 wherein said power source is affixed to said body portion adjacent an upper end thereof.

4. Power driving apparatus according to claim 1 wherein said power source is affixed intermediate along the length of said body portion.

5. Power driving apparatus according to claim 1 wherein said power supplying portion includes clutch means associated with said output shaft member.

6. Power driving apparatus according to claim 1 wherein said rotatable eccentric means includes a crank member.

7. Power driving apparatus according to claim 1 wherein said rotatable eccentric means is disposed along the upper half of said body portion.

8. Power driving apparatus according to claim 1 wherein said arm member is a flexible element.

9. Power driving apparatus according to claim 1 wherein said arm member is a rod member.

10. Power driving apparatus according to claim 1 wherein said arm member is a chain.

11. Power driving apparatus according to claim 1 wherein said drive portion includes clutch means associated with said rotatable eccentric means.

12. Power driving apparatus according to claim 1 wherein said drive portion includes sprockets on said output shaft member and on said eccentric means connected by an endless drive element.

13. Power driving apparatus according to claim 12 including shock absorbing means yieldably bearing against said endless drive element.

14. Power driving apparatus according to claim 1 wherein said biasing portion is disposed within said body portion.

15. Power driving apparatus according to claim 1 wherein said coil spring member is aligned axially with said body portion.

16. Power driving apparatus according to claim 1 wherein said toolhead member is a wedge member.

17. Power driving apparatus according to claim 1 wherein said toolhead member is a post driver.

18. Power driving apparatus according to claim 17 wherein said post driver includes a post engaging opening extending upwardly from said toolhead member.

19. Power driving apparatus according to claim 1 including a handle portion with gripping means extending in opposite directions from said body portion.

20. Power driving apparatus according to claim 1 including shock absorbing means disposed between adjacent surfaces of said toolhead member and said body portion.

* * * * *